US008608863B2

(12) United States Patent
Stremel, III

(10) Patent No.: US 8,608,863 B2
(45) Date of Patent: Dec. 17, 2013

(54) SYSTEM AND METHOD FOR FLUSHING CASTINGS

(75) Inventor: Jerome Francis Stremel, III, Bluffton, SC (US)

(73) Assignee: Parker-Hannifin Corporation, Cleveland, OH (US)

( * ) Notice: Subject to any disclaimer, the term of this patent is extended or adjusted under 35 U.S.C. 154(b) by 451 days.

(21) Appl. No.: 12/963,010

(22) Filed: Dec. 8, 2010

(65) Prior Publication Data

US 2011/0265819 A1 Nov. 3, 2011

Related U.S. Application Data

(60) Provisional application No. 61/329,186, filed on Apr. 29, 2010.

(51) Int. Cl.
*B08B 9/02* (2006.01)

(52) U.S. Cl.
USPC ..... 134/22.14; 134/22.11; 134/22.1; 134/42

(58) Field of Classification Search
USPC ..... 134/22.1, 22.11, 22.12, 22.14, 22.18, 134/22.19, 34, 36, 42
See application file for complete search history.

(56) References Cited

U.S. PATENT DOCUMENTS

| | | | | |
|---|---|---|---|---|
| 3,492,159 | A | 1/1970 | Nowlin | |
| 4,303,453 | A * | 12/1981 | Jung et al. | 134/10 |
| 5,024,766 | A | 6/1991 | Mahmud | |
| 5,061,374 | A | 10/1991 | Lewis | |
| 5,183,512 | A | 2/1993 | Bragger | |
| 5,248,393 | A | 9/1993 | Schumacher et al. | |
| 6,579,449 | B2 | 6/2003 | Okada | |
| 6,649,064 | B2 | 11/2003 | Parekh et al. | |
| 6,857,436 | B2 * | 2/2005 | Labib et al. | 134/22.1 |
| 2001/0042715 | A1 | 11/2001 | Parekh et al. | |
| 2009/0026137 | A1 | 1/2009 | Chen et al. | |

FOREIGN PATENT DOCUMENTS

| | | |
|---|---|---|
| EP | 1 537 907 A1 | 6/2005 |
| GB | 2 457 893 A | 9/2009 |
| JP | 8-229667 | 9/1996 |

OTHER PUBLICATIONS

International Search Report and Written Opinion of corresponding International Application No. PCT/US2011/034260, dated Jul. 5, 2011.

* cited by examiner

*Primary Examiner* — Saeed T Chaudhry
(74) *Attorney, Agent, or Firm* — Renner, Otto, Boisselle & Sklar, LLP

(57) ABSTRACT

A method for cleaning a component comprises a first stage including the steps of: (i) loading a component into the cleaning chamber of a flush station, (ii) directing a deionized water stream through first filter means, (iii) introducing carbon dioxide into the filtered water stream, (iv) directing the carbonated water stream into a fluid passage to be cleaned in the component, and (v) collecting the dirty water stream after it passes through the component and directing the collected dirty water stream through second filter means for reuse. The method can further include a second stage including the steps of: (vi) loading the component into a testing chamber of a testing station, (vii) directing a deionized water stream through third filter means, (viii) directing the filtered water stream into the fluid passage in the component, and (ix) collecting the water stream after it passes through the component and directing the collected water stream into a particle counter.

12 Claims, 1 Drawing Sheet

SYSTEM AND METHOD FOR FLUSHING CASTINGS

RELATED APPLICATIONS

This application claims the benefit of U.S. Provisional Application No. 61/329,186 filed Apr. 29, 2010, which is hereby incorporated herein by reference.

FIELD OF THE INVENTION

The invention relates to a system and method for using water to clean castings, particularly castings with complex internal passageways.

BACKGROUND OF THE INVENTION

Metal casting has evolved to allow for the casting of more complex workpieces. Some of these casting processes begin with a pattern created in foam or wax. These materials are relatively easy to form in complex shapes. The patterns often are coated with a material to minimize or prevent the mold material, typically sand or clay, from sticking to the completed workpiece or otherwise impacting the surface finish of the workpiece. The pattern is then packed in the mold material and molten metal is poured into the mold. The hot metal melts and displaces the foam or wax pattern so that the workpiece is formed in the shape of the pattern. After cooling to solid form, the workpiece is removed from the mold.

When a cast workpiece is removed from its mold, the workpiece must be cleaned of residue, including sand and clay particles from the mold material, foam or wax residue, and releasing agents and surface finish agents, for example, applied to the wax or foam pattern. The casting is cleaned to provide a clean surface for further processing or to remove reside that could damage the finished assembly of which the casting is a part. The cleaning process can include brushing residue off the exterior, washing with water, and shot blasting with an abrasive material, for example.

SUMMARY OF THE INVENTION

Complex workpieces, and particularly workpieces with complex internal passageways, can be more difficult to clear of residual material. The present invention provides an improved cleaning process that introduces carbon dioxide into a stream of water. This carbonated water is directed into a passage in a workpiece to flush residue from the passage. Afterward, the efficacy of the cleaning process can be tested by directing a clean water stream through the passage and then past a particle detector. The particle detector indicates whether particles of a size greater than a predetermined size are evident.

More particularly, the present invention provides a method for removing residual material from an internal passage of a workpiece, including the step of passing carbonated water through the passage to flush residual material from the passage in the workpiece, where the workpiece is a metal casting.

The method can further include one or more of the following features: (a) the step of passing the water through a first filter before passing the water through the passage in the workpiece; (b) the step of passing water through the passage in the workpiece includes passing carbonated, deionized water through the passage in the workpiece; (c) the step of introducing carbon dioxide into water to form carbonated water; (d) the step of collecting the water after it passes through the workpiece; (e) the step of passing the collected water through a second filter; (f) the step of reusing the filtered collected water.

The present invention also provides a method of testing the cleanliness of an internal passage of a workpiece. The method includes the steps of cleaning the passage using the method described above; passing water through the passage in the workpiece after the cleaning step; collecting the water after it passes through the workpiece; and passing the collected water through a particle detector which provides an indication of whether particles of a size greater than a predetermined size are present in the collected water.

The present invention further provides a method of casting a metal workpiece. This method includes the steps of creating a pattern; packing sand around the pattern in a mold; pouring molten metal into the mold and displacing the pattern material with metal to create a metal workpiece; and removing residual material from internal passages in the metal workpiece in accordance with the method described above.

The present invention also provides a system for removing residual material from an internal passage of a workpiece. The system includes a flush station having a fluid circuit that includes a supply of water, a supply of carbon dioxide, a valve for introducing carbon dioxide into the water, a workpiece support downstream of the carbon-dioxide-introducing valve. A passage in a workpiece mounted to the support completes the fluid circuit.

Further features of the invention will become apparent from the following detailed description when considered in conjunction with the drawings.

DETAILED DESCRIPTION

The present invention provides an improved cleaning process that uses carbonated water to flush passages in a workpiece formed as a metal casting.

Subsequently, the efficacy of the cleaning process can be tested by flushing the passages with clean water and analyzing the water exiting the workpiece with a particle detector. The particle detector or other sensor indicates whether particles of a size greater than a predetermined size, generally less than 1000 μm, are present in the water exiting the workpiece.

Figure 1:
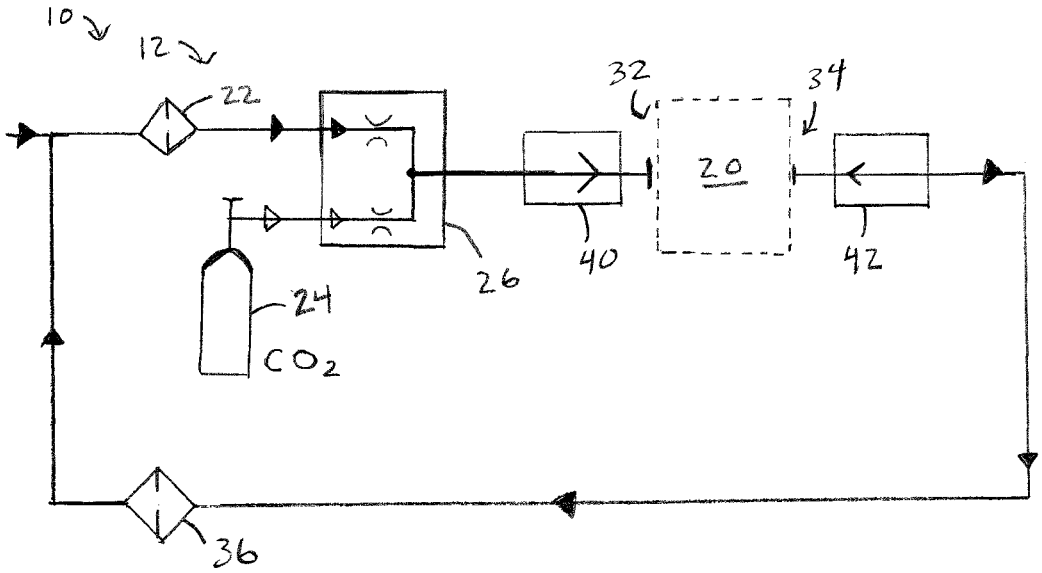
FIG. 1 is a schematic representation of an exemplary system provided in accordance with the present invention.

Referring now to the drawings in detail, and initially FIG. 1, an exemplary system 10 includes both a cleaning station 12 and a testing station 14 (FIG. 2) for cast parts or workpieces 20, such as a lost foam casted aluminum housing, particularly ones with complex internal flow paths. Such workpieces typically are components in articles of manufacture that require a predetermined degree of cleanliness in each component. A schematic fluid diagram of the cleaning station 12 is shown in FIG. 1. Beginning in the upper left corner, water enters and passes through a first filter 22. The water typically includes deionized water or water obtained by a reverse osmosis process. Carbon dioxide gas, from a source such as a pressurized tank 24, is introduced to the water, such as through a mixing valve 26 also connected to the water line. The output of the mixing valve is a carbonated, filtered water. This carbonated water is then injected into passages in a workpiece 20 to be cleaned. The passages in the workpiece are coupled to the fluid circuit such that the carbonated water enters the workpiece on an inlet side 32 and exits the workpiece 20 at an outlet side 34. The water exiting the workpiece 20 then passes through a second filter 36 before being recirculated for reuse.

If deionized water comes to the station through standard black pipe, it often will have rust in it that needs to be filtered out before it enters the workpiece. If the supply of deionized water is free of particles greater than a predetermined maximum, such as 600 μm, then no further filtering would be required prior to flushing the workpiece.

The carbonation of the water aids in surfaction on the outside of the carbon dioxide bubbles' effervesance. The interaction of deionized water and carbon dioxide typically provides the best cleaning. The lack of ions in the deionized cleaning water improves the surfactant qualities of the carbon dioxide bubbles. This helps the bubbles attract and retain particles, including residual material from the mold pattern itself or release agents used to coat the pattern. Reverse-osmosis water also could be used, but the cost of reverse-osmosis water generally is much higher than the cost of deionized water. Consequently, reverse-osmosis water typically is used only with materials that are incompatible with deionized water.

There is a complex relationship between the flow rate and cleanliness of a workpiece. In some complex passageways, injecting water into the passageway at too high a pressure creates a Venturi effect that inhibits the removal of contaminant material. Both cycle time and pressure can be varied to optimize each stage of the cleaning and testing process. For example the water pressure is optimized to avoid knocking the particles off the bubbles before they exit the workpiece. Less convoluted or otherwise complex passageways, for example, can tolerate higher pressures, higher flow rates, and shorter cycle times while ensuring that a high level of cleanliness is achieved.

Figure 2:
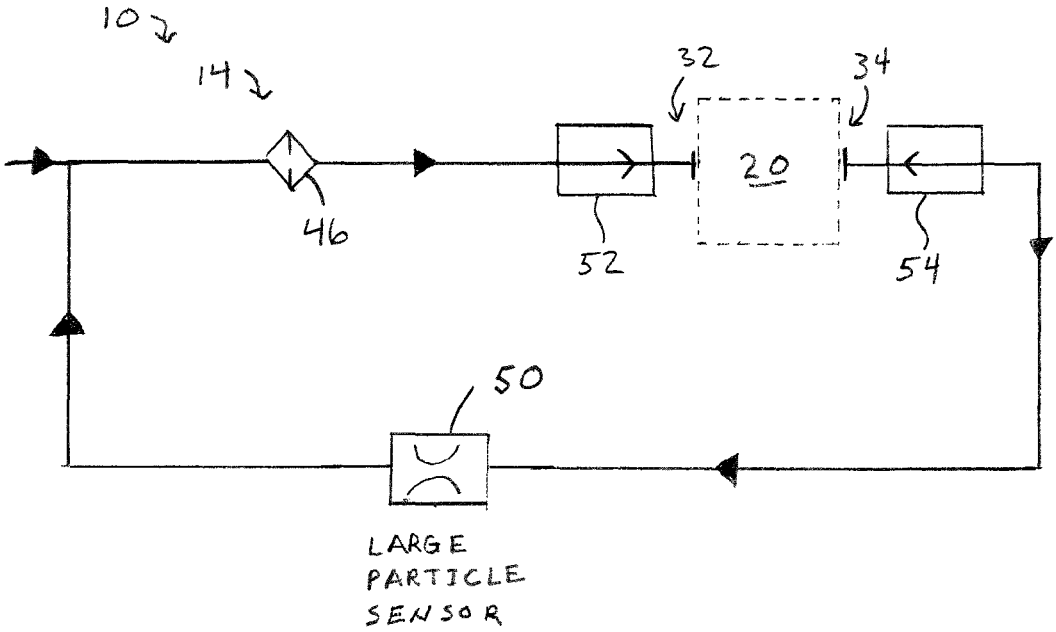
FIG. 2 is a flowchart of an exemplary method provided in accordance with the present invention.

To operate the cleaning station 12, an operator typically will load a workpiece 20 into the fluid circuit by positioning the workpiece 20 in place and then activating automated taps 40 and 42 to seal the fluid inlet 32 and outlet 34 connections to respective ports on the workpiece 20. Alternatively the taps 40 and 42 can be connected by hand. A reservoir or holding tank (not shown) typically is provided to store a supply of water ready for use, particularly for holding the water while a workpiece is being replaced. The operator then activates the appropriate pumps to cycle the water through the first filter 22 before introducing carbon dioxide into the filtered water. The carbonated water passes through the workpiece 20, entering at the inlet 32, and drains through the outlet 34 to flush contaminants from the passages. The water exiting the workpiece 20 passes through the second filter 36 and is recirculated for reuse. Once the flush cycle is complete, typically predetermined by time (such as forty seconds, minimum, to ensure that 98% of parts will pass at the subsequent testing station), the operator releases the workpiece 20 and passes it along to the testing station 14 (FIG. 2). Alternatively, the process can be automated such that no operator is required.

An exemplary testing station 14 is shown schematically in FIG. 2. Beginning again in the upper left corner, water enters and passes through a third filter 46 before passing through the passages in the workpiece 20. The passages in the workpiece 20 are coupled to the fluid circuit such that the water enters the workpiece on an inlet side 32 and exits the workpiece 20 at an outlet side 34. The water exiting the workpiece then passes through a sensor 50 before being recirculated for reuse. The sensor 50, which can include a particle counter, detects particles larger than a predetermined size, such as 200 μm, and outputs a signal indicating how many such particles are detected within a predetermined time or calculated volume of water. This indicates the cleanliness of the passages in the workpiece.

To operate such a testing station 14, an operator will begin by loading the workpiece 20 into the fluid circuit by positioning the workpiece in place and then connecting taps 52 and 54 to seal the fluid inlet 32 and outlet 34 connections to respective ports on the workpiece. The operator then activates the appropriate pumps to cycle the water through the third filter and then through the passages in the workpiece, from the inlet 32 to the outlet 34. Water exiting the outlet 34 then passes through the in-line sensor 50 to verify the cleanliness of the passages and thus the workpiece. For example the sensor 50 may check for particles greater than 200 μm for a calculated volume of 3.1 liters of water. The carbon dioxide and any air bubbles in the water typically are removed prior to the sensor 50 or particle counter, and preferably a laminar flow is maintained through the sensor 50. Once cleanliness requirements are met, the workpiece 20 is released and can be forwarded to a subsequent station.

Although the illustrated system includes two stations, a cleaning station 12 (FIG. 1) and a separate testing station 14 (FIG. 2), the functions of the cleaning station and the testing station could be combined at a single station using properly controlled valves. A subsequent station (not shown) typically applies a vacuum to the passageways to remove remaining water, and then blows dry air through the passageways to further ensure that all of the water is removed. It also may be possible to combine such a station with the functions provided by the stations provided by the present invention.

As an alternative, the workpiece first can be flushed with deionized or reverse-osmosis water alone to remove the largest particles, for example, particules larger than 600 μm, and then flushed with carbonated water to remove smaller particles. The decision whether to use this method depends on the cost to include carbon dioxide in comparison to the cost of a longer cycle time.

According to an exemplary embodiment, the present invention provides a method for cleaning a component comprises a first stage including the steps of: (i) loading a component into the cleaning chamber of a flush station, (ii) directing a deionized water stream through first filter means, (iii) introducing carbon dioxide into the filtered water stream, (iv) directing the carbonated water stream into a fluid passage to be cleaned in the component, and (v) collecting the dirty water stream after it passes through the component and directing the collected dirty water stream through second filter means for reuse. The method can further include a second stage including the steps of: (vi) loading the component into a testing chamber of a testing station, (vii) directing a deionized water stream through third filter means, (viii) directing the filtered water stream into the fluid passage in the component, and (ix) collecting the water stream after it passes through the component and directing the collected water stream into a particle counter. The particle counter provides an indication of whether particles of a size greater than a predetermined size are evident in the collected water stream.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

I claim:

1. A method for removing residual material from, and thereby cleaning, an internal passage of a workpiece, comprising the step of passing carbonated water through the passage to flush residual material from the passage in the workpiece, where the workpiece is a metal casting.

2. A method as set forth in claim 1, where the step of passing carbonated water through the passage in the workpiece includes passing carbonated, deionized water through the passage in the workpiece.

3. A method as set forth in claim 1, comprising the step of introducing carbon dioxide into water to form carbonated water.

4. A method as set forth in claim 3, comprising the step of passing the water through a first filter before the introducing step, where the water includes deionized water.

5. A method as set forth in claim 1, comprising the step of collecting the carbonated water after it passes through the workpiece.

6. A method as set forth in claim 5, comprising the step of passing the collected carbonated water through a second filter.

7. A method as set forth in claim 6, comprising the step of reusing the filtered collected carbonated water.

8. A method of testing the cleanliness of an internal passage of a workpiece, comprising the following steps:

cleaning the passage using the method of claim 1;

passing carbonated water through the passage in the workpiece after the cleaning step;

collecting the carbonated water after it passes through the workpiece; and removing carbon dioxide from the collected carbonated water, and then passing the collected water from which the carbon dioxide has been removed through a particle detector which provides an indication of whether particles of a size greater than a predetermined size are present in the collected water.

9. A method as set forth in claim 1, comprising the step of loading a workpiece into a cleaning station and then a testing station.

10. A method as set forth in claim 9, where the steps of passing carbonated water through the passage in the workpiece after the cleaning step, collecting the carbonated water, and removing the carbon dioxide and passing the collected water through a particle detector continue until no particles greater than a predetermined size are detected in the predetermined volume.

11. A method as set forth in claim 1, where the passing step occurs for a predetermined period.

12. A method as set forth in claim 1, comprising the step of flushing the passage with deionized water or reverse-osmosis water before the step of passing carbonated water through the passage.

* * * * *